United States Patent [19]

Iimura

[11] Patent Number: 4,923,430

[45] Date of Patent: May 8, 1990

[54] COIN PAYOUT APPARATUS IN GAMING DEVICE

[75] Inventor: Kouichi Iimura, Atsugi, Japan

[73] Assignee: Kabushiki Kaisha Sigma, Tokyo, Japan

[21] Appl. No.: 255,109

[22] Filed: Oct. 7, 1988

[30] Foreign Application Priority Data

Oct. 14, 1987 [JP] Japan ..... 62-156078[U]
Oct. 28, 1987 [JP] Japan ..... 62-163641[U]

[51] Int. Cl.[5] ..... G07D 1/00; G07D 9/04

[52] U.S. Cl. ..... 453/50; 453/40; 453/58; 221/267; 221/307

[58] Field of Search ..... 453/24, 25, 29, 30, 453/31, 32, 35, 39, 40, 44, 48, 50, 57, 58, 51, 52; 221/2, 3, 267, 307, 232

[56] References Cited

U.S. PATENT DOCUMENTS

| | | | |
|---|---|---|---|
| 1,024,057 | 4/1912 | Bock | 453/31 |
| 1,808,270 | 6/1931 | Vogt | 453/35 |
| 3,563,410 | 2/1971 | Murray | 221/3 X |
| 3,978,873 | 9/1976 | Gross | 453/35 |
| 3,997,063 | 12/1976 | Adams et al. | 221/2 X |
| 4,437,478 | 3/1984 | Abe | 453/32 |
| 4,592,377 | 6/1986 | Paulsen et al. | 453/33 |
| 4,746,319 | 5/1988 | Zwieg et al. | 453/35 X |

FOREIGN PATENT DOCUMENTS

| | | | |
|---|---|---|---|
| 3522119 | 1/1986 | Fed. Rep. of Germany | 453/32 |

*Primary Examiner*—Joseph J. Rolla
*Assistant Examiner*—Edward S. Ammeen
*Attorney, Agent, or Firm*—Ladas & Parry

[57] ABSTRACT

A coin payout apparatus in a gaming device. The apparatus includes a coin hopper and a coin guide connected to the hopper for successively delivering coins in edge-to-edge relationship. A rotary arm is pivotally provided at the coin guide and has one end rotatably providing a coin ejector roller. The rotary arm is normally biased toward the coin in the coin guide by a biasing member. A supplemental coin ejecting member is provided at a position confronting the ejector roller. When the maximum diameter portion of the coin passes through the space defined between ejector roller and the supplemental coin ejecting member, the coin is urgedly discharged by the biasing force of the biasing member.

1 Claim, 2 Drawing Sheets

COIN PAYOUT APPARATUS IN GAMING DEVICE

BACKGROUND OF THE INVENTION

The present invention relates to a coin payout apparatus for use in a gaming device such as a slot machine. More particularly, the invention relates to the coin payout apparatus at a tip end portion of a coin guide in the gaming device.

Generally, in a coin payout apparatus of this type, a plurality of coins are accummulated in a coin hopper, and a predetermined number of coins are automatically dispensed one by one in accordance with a game result from a coin dispenser opening through the coin guide. According to one conventional coin payout apparatus, each one of the coins springs out of the coin guide tip end which is in communication with the coin dispensing opening as disclosed in U.S. Pat. No. 4,518,001 assigned to International Game Technology.

However, after termination of coin payout, coin cheating may be conducted against coins retained in the coin guide by unfare raking or scraping by means of a pin or the like. Further, such remaining coins may undergo mischief. In this regard, the conventional apparatus does not provide sufficient countermeasures against such cheating and mischief. Further, accurate coin counting with simple construction is further required in accordance with the game result.

SUMMARY OF THE INVENTION

It is therefore, an object of the present invention to overcome the above-described prior art drawbacks, and to provide an improved coin payout apparatus for use in a gaming device.

Another object of this invention is to provide such apparatus capable of accurately counting the coin payout number with simple construction.

Still another object of this invention is to provide such apparatus which can prevent the coin from unfare cheating during non-service state of the gaming device.

These and other objects of this invention will be attained by providing a coin payout apparatus which includes a coin hopper storing therein a plurality of coins; coin guide connected to the hopper for successively delivering coins in edge-to-edge relationship from the hopper to a coin dispensing opening, the coin payout apparatus comprising; a rotary arm pivotally supported to the coin guide, the rotary arm having one end portion movable toward and away from the coin in the coin guide; a coin ejecting roller rotatably supported to the one end portion of the rotary arm, the coin ejecting roller being in rotatal contact with an outer peripheral surface of leading coin in the coin guide; a biasing means connected to the one end portion of the rotary arm for biasing the one end toward the leading coin; and, a supplemental coin ejecting means positioned in confrontation with the coin electing roller, the supplemental coin electing means being rotatably supported for ejecting the leading coin in cooperation with the coin electing roller.

Coins stored in the hopper are delivered through the coin guide in edge-to-edge relationship to a coin dispensing opening. When the maximum diameter portion of the leading coin passes through the ejector roller and the supplemental coin ejecting means, the leading coin will be urgedly discharged because of the biasing force of the biasing means. At every discharge of the coins, the rotary arm performs rocking movement.

According to a first embodiment of this invention, the rotary arm is pivoted at its intermediate portion. Another end of the rotary arm pivotally supports a locking roller. During the non-service state of the gaming device, since the coins are not successively moved in the coin guide, the locking roller is in close contact with the upper peripheral half portion of the second coin when the ejector roller is forcibly moved away from the first coin so as to cheat the first coin. This close contact between the locking roller an the second coin prevents the ejector roller from being further moved away from the first coin, and therefore, cheating of the first coin is avoidable.

According to a second embodiment of this invention, the rotary arm is pivotally supported at its intermediate portion similar to the first embodiment. Alternatively, the rotary arm is pivotally supported at its another end. In the latter case, the locking roller is not required. Instead, the supplemental ejector is of star shape serving as a count cam. When the maximum diameter portion of the leading coin passes through the ejector roller and the count cam, the coin will be urged outwardly by the biasing force of the biasing means. In this instance, the count cam is angularly rotated. This angular rotation is detected by a sensor for generating a pulse signal. The exact coin discharge is directly detected by the combination of the star shaped count cam and the sensor for accurate coin payout counting.

DETAILED DESCRIPTION OF THE PREFERRED EMBODIMENTS

Figure 1:
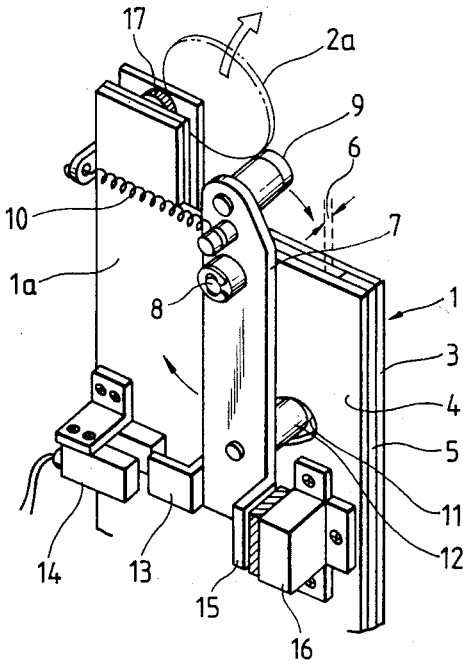
FIG. 1 is a perspective view showing a coin payout apparataus according to a first embodiment of this invention.
Figures 2A, 2B, 2C, 2D:
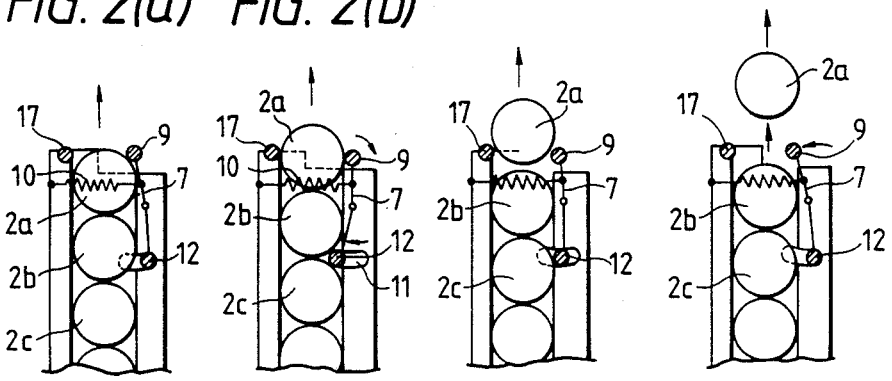
FIGS. 2(*a*) thru 2(*d*) show schematic illustrations for description of operations according to the first embodiment.
Figure 3:
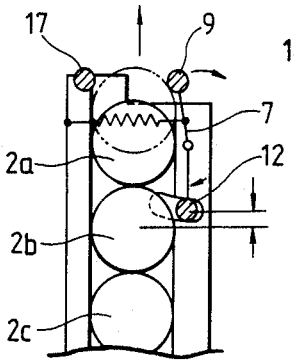
FIG. 3 is a schematic illustration for description of cheat-preventive manner according to the first embodiment.

A first embodiment according to this invention will be described with reference to FIGS. 1 thru 3. A coin guide 1 is adapted to guide travel of coin 2 successively delivered in single edge-to-edge array froma coin hopper (not shown) toward a coin dispensing opening (not shown). The coin guide 1 is elevated from the hopper. The coin guide 1 includes a pair of guide plates 3 and 4 confronting with each other and spaced away from each other by a spacer 5. The spacer 5 defines sufficient width or space 6 slightly larger than a thickness of the coin so as to allow the coin to pass therethrough in edge-to-edge configuration as shown in FIGS. 2(*a*) to 3. This space 6 is uniformly provided in a direction of travel of the coins, so that the space functions as a guide passage for the coin.

At a tip end portion 1*a* of the coin guide 1, a rotary arm 7 is pivotably supported, and which is directed in a direction substantially parallel with the payout direction of the coin as indicated by the arrow. The rotary arm 7 has an intermediate portion pivotably supported by a shaft 8 so that the arm 7 is pivoted in a substantially radial direction of the coin 2.

A kick or ejector roller 9 is rotatably supported at one end (upper end in FIG. 1) of the rotary arm 7. The ejector roller 9 is directed in a direction perpendicular to the rotary arm 7, and is positioned in confrontation with an open outlet end of the coin guide 1. An outer peripheral surface of the kick roller 9 is in rotational contact with an outer peripheral end surface of the coin 2*a* (hereinafter simply referred to as a first coin 2*a*).

A biasing means such as a coil spring 10 is disposed between a coin guide 1 and the one end portion of the rotary arm 7, so that the rotary arm 7 is normally biased toward the outer periphreal surface of the first coin 2*a*. Further, a supplemental coin ejecting means such as an auxiliary roller 17 is rotatably provided at one distal end of the coin guide 1. When the lower half portion of the first coin 2*a* is brought to a position where the lower half portion of the coin is interposed between the kick roller 9 and the supplemental ejecting means 17, the coin will be ejected in the direction shown by the arrow in FIG. 1 because of the biasing force of the coil spring 10.

A locking roller 12 is rotatably supported to another end portion of the rotary arm 7. The locking roller 12 extends in parallel with the kick roller 9. Further, the coin guide 1 is formed with an arcuate slot 11 engageable with the locking roller 12. The locking roller 12 has an outer peripheral surface which is in selective rotational contact with an outer peripheral surface of a subsequent second or third coin 2*b* or 2*c*.

A protrusion piece 13 protrudes from a side edge of the another end portion of the rotary arm 7. Further, a sensor 14 is fixedly secured to the coin guide 1 and at a position adjacent to the protrusion piece 13. The sensor 14 generates an output ON/OFF signal (pulse signal) upon every discharge of the coins responsive to the every rocking motion of the rotary arm 7. That is, the protrusion piece 13 is movable toward and away from the sensor 14 by the rocking motion of the rotary arm 7, so that every coin payout is detected by the sensor 14. The sensor 14 may preferably be a non-contact type sensor such as, for example, a magnetic proximity switch and photocoupler. This detection signal is transmitted to a counter (not shown), so that coin payout number is counted.

At another side edge of the another end portion of the rotary arm 7, there is provided a stop member 15. Further, a stop means 16 is fixedly secured to the coin guide 1. The stop member 15 is brought into abutment with the stop means 16, so that excessive rocking motion of the rotary arm 7 can be prevented.

Operational mode according to the first embodiment will next be described. First, as shown in FIG. 2(*a*), each of the coins 2*a*, 2*b* and 2*c* is forcibly supplied from the hopper in edge-to-edge alignment in the coin guide passage. In this case, the one end of the rotary arm 7 is urged toward the upper half peripheral portion of the first coin 2*a* by the biasing force of the coil spring 10, and the locking roller 12 is spaced away from the second coin 2*b*.

Next, as shown in FIG. 2(*b*), each of the coins is further elevated by the driving force from the hopper, so that the first coin 2*a* squeeze itself between the ejector roller 9 and the auxiliary ejector roller 17 against biasing force of the coil spring 10. As a result, the locking roller 12 is moved toward a boundary defined between the subsequent coins 2*b* and 2*c*. In this instance, the kick roller 9 is in contact with the maximum diameter portion of the first coin 2*a*. Further, simultaneously, the protrusion piece 13 is moved into the sensor 14, so that the pulse signal is outputted therefrom. This output signal implies the one coin payout, and the output signal is transmitted into the counter (not shown).

Thereafter, as shown in FIG. 2(*c*), when the coins are further advanced, the kick roller 9 is brought into contact with the lower half peripheral surface of the first coin 2*a*. As a result, the one end of the rotary arm 7 is rapidly moved radially inwardly with respect to the coin because of the biasing force of the coil spring 10, and accordingly, the kick roller 9 and the auxiliary roller 17 spring out the coin 2*a*.

Then, as shown in FIG. 2(*d*), the second coin 2*b* will be at stand-by position for the subsequent payout operation. In this state, the rotary arm 7 is at suspensing position defined by the stop member 15 and the stop means 16. Such operations are repeatedly carried out for successive coin payout.

The first embodiment as described above also provides coin cheat-preventive function. Upon termination of coin payout for a player, the gaming machine is subjected to a coin payout for the next game. FIG. 3 shows a stand-by state of the coin payout device for the next game. If the first coin 2*a* is intended to be raked out by using a pin or the like, the upper half portion of the coin is brought into abutment with the kick roller 9, and the one end of the rotary arm 7 may be moved to a direction radially outwardly of the coin 2*a* against the biasing force of the coil spring 10. However, in this case, since the second coin 2*b* is not moved upwardly because of non-service state of the gaming machine, the lock roller 12 is moved toward the second coin and is abutted at the upper half portion thereof. Accordingly, the upper end portion of the rotary arm 7 cannot be further moved any more, to thereby prevent the first coin from being removed out. That is, advancing movement of the first coin 2*a* is still interrupted by the kick roller 9. (During the service state, the lock roller 12 will be entered into the boundary between the second and the third coins, so that the kick roller 9 can further be moved radially outward direction of the coin 2*a* to permit the coin to pass therethrough.) By the suitable determination of the dimension of the rotary arm 7 relative to the coin 2, cheatpreventive function can be given in this embodiment.

According to this embodiment, in addition to the cheat preventive function, movement of the rotary arm 7 is detectable by the projection piece 13 and the sensor 14. Therefore, additional coin payout number detector is not required. Instead, by the utilization of the rotary arm per se, coin payout number can be detected, to thus render the overall device simple. Further, the cheat preventive function can be provided mechanically, not electrically. Therefore, even at the general failure of power supply, coin cheating is still avoidable.

Figure 4:
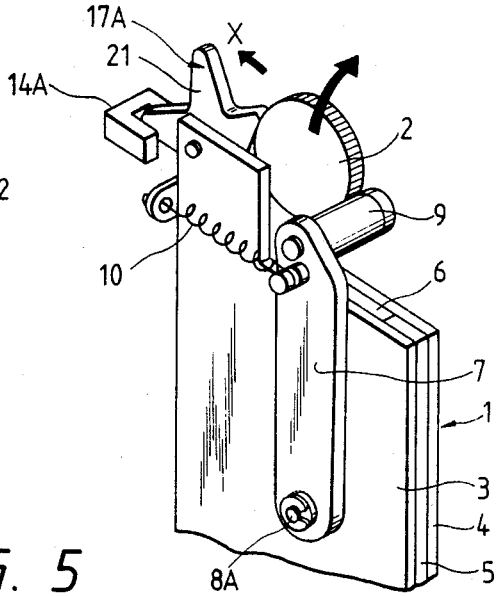
FIG. 4 is a perspective view showing a coin payout appartus according to a second embodiment of this invention; and, FIG. 5 is a view partly showing a block diagram according to the second embodiment.

A second embodiment according to the present invention will be described with reference to FIGS. 4 and 5 wherein like parts and components are designated by the same reference numerals and characters as those shown in the first embodiment. According to the second embodiment, a supplemental coin ejector means 17A is in the form of a star shape 21. The star shaped member 21 also serves as a count cam rotatably provided to the coin guide 1. Between a pair of neighboring projections 22 and 22, a recessed portion 22*a* is defined in which a part of the outer peripheral surface of the coin 2 is supportedly held. At a side of the count cam 21, a counting sensor 14A is provided. The sensor 14A has C-shape as shown in FIG. 4, so that projections 22 can pass through the open space of the sensor 14A. Similar to the first embodiment, a non-contact type sensor such as a photocoupler and magnetic proximity switch is incorporated in the sensor 14A, so as to count each one of the projections 22 for producing a corresponding pulse signal.

As shown in FIG. 4, the rotary arm 7 has another end (lower end) pivotally supported to the coin guide 1 by means of a shaft 8A. However, the rotary arm 7 can be pivotally supported at its intermediate portion so as to rotatably provide the locking roller 12 at the another end similar to the first embodiment.

Figure 5:
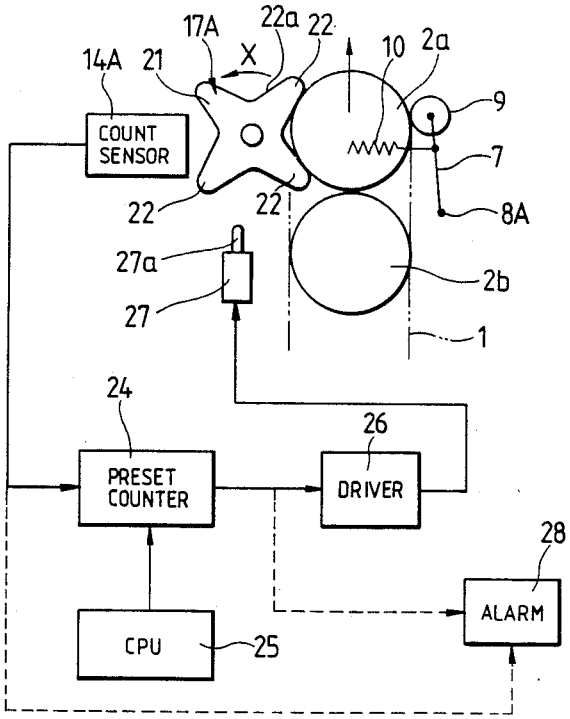

As shown in FIG. 5, the count sensor 14A is connected to a preset counter 24, so that the output pulse signal from the sensor 14A is sent to the counter 24. In the preset counter 24 stored are preset count values each coresponding to coin payout numbers in accordance with the game result. If the pulse signal from the count sensor 14A reaches preset value, the counting is over, and a pulse signal is outputted for a reset. A central processing unit (CPU) 25 is connected to the preset counter 24. The CPU 25 controls entire system for sending the preset count value to the preset counter 24.

The preset counter 24 is also connected to a driver 26 which is connected to a locking means 27 for locking the count cam 17A. The locking means 27 includes an electromagnetic solenoid having a plunger 27*a*. In response to the output signal from the preset counter 24, the driver 26 moves the locking means 27, so that the plunger 27*a* of the electromagnetic solenoid 27 extends into the recessed portion 22*a* of the count cam 17A. As a result, further rotation of the count cam 17A is prevented.

The preset counter 24 is connected to an alarm unit 28 which is also connected to the count sensor 14A. When the output signal from the preset counter 24 is ANDed with the output signal from the count sensor 14A, the unit 28 generates alarm. That is, that the output signal from the preset counter 24 is inputted into the alarm unit 28 implies that necessary coin payout is completed. However, if the output signal is sent from the count sensor 14A to the alarm unit 28 after the output signal from the preset counter 24 is inputted into the alarm unit 28, it can be recognized that unfare cheating is conducted. Therefore, this logical product generates the alarm. Incidentally, the electromagnetic solenoid 27 and the alarming unit 28 can be used selectively, or be co-used.

Next, an operation according to the second embodiment will be described. For the coin payout, each of the coins 2*a*, 2*b*, is delivered upwardly in edge-to-edge relationship as shown in FIG. 2 from the hopper (not shown). In this case, the one end portion of the rotary arm 7 is urged radially inwardly with respect to the coin by the biasing force of the spring 10. Further, when each of the coins is further elevated, the first coin 2*a* is thrusted into a space between the kick roller 9 and the star shaped count cam 17A, so that the kick roller 9 is moved in radially outward direction with respect to the coin. When the first coin 2*a* is further advanced and the maximum diameter portion of the coin 2*a* passes through the kick roller 9, the kick roller 9 can be moved radially inwardly relative to the coin because of the biasing force of the coil spring 10. As a result, the coin 2*a* springs out of the kick roller 9. In this instance, the first coin 2*a* is in abutment with on of the projections 22 of the star shaped count cam 17A, so that the count cam 17A is angularly rotated in a direction indicated by an arrow X. Upon this angular rotation, one of the remaining projections 22 of the star shaped count cam 17A passes through the count sensor 14A, to thereby generate the pulse signal. This pulse signal is subjected to counting at the preset counter 24.

Such operation is repeatedly carried out until the count number reaches the preset value given by the CPU 25. Then, the electromagnetic solenoid 27 is actuated to interlock the count cam 17A. As a result, further coin payout is prevented. If cheating is thereafter conducted, the alarm unit 18 is actuated.

According to the second embodiment, similar to the first embodiment, coin payout is directly detected, to thereby facilitate coin payout counting with high accuracy and high stability.

While the invention has been described in detail and with reference to specific embodiment thereof, it would be apparent for those skilled in the art that various changes and modifications can be made therein without departing from the spirit and scope of the invention.

What is claimed is:

1. A coin payout apparatus in a gaming device which includes a coin hopper storing therein a plurality of coins and a coin guide generally in the shape of an elongated flat plate connected to the hopper for successively delivering coins in edge-to-edge relationship from the hopper to a coin dispensing opening, said coin payout apparatus comprising:

a rotary arm pivotally mounted to said coin guide at substantially a central portion of one surface of said coin guide in a widthwise direction thereof, said rotary arm having one end portion movable toward and away from said coin guide;

a coin ejecting roller rotatably supported to said one end portion of the rotary arm, said coin ejecting roller being in rotational contact with an outer peripheral surface of a leading coin in said coin guide;

a biasing means connected to said one end portion of said rotary arm for biasing said one end toward said leading coin;

a supplemental coin ejecting means positioned in confrontation with said coin ejecting roller, said supplemental coin ejecting means being rotatably supported for ejecting the leading coin in cooperation with said coin ejecting roller;

a detecting means for detecting rocking movements of said rotary arm comprising a non-contact type sensor means mounted on said one surface of said coin guide on one side of said rotary arm in the widthwise direction thereof and a protruding piece provided for a lower end of said rotary arm to be movable toward and away from said sensor means in association with the rocking motion of said rotary arm, said sensor means having a structure allowing said protruding piece to enter in a non-contact manner, said sensor means generating a pulse signal in response to entry of said protruding piece; and a stopper means mounted on said one surface of said coin guide on the side of said rotary arm opposite said one side to restrict a backward movement of said rotary arm.

* * * * *